United States Patent [19]

Hon

[11] Patent Number: 4,813,240

[45] Date of Patent: Mar. 21, 1989

[54] METHOD AND APPARATUS FOR MAINTAINING A CONSTANT ACTIVE CONCENTRATION IN A COOLING TOWER

[75] Inventor: Clarence C. Hon, Cherry Hill, N.J.

[73] Assignee: Mobil Oil Corporation, New York, N.Y.

[21] Appl. No.: 148,741

[22] Filed: Jan. 27, 1988

[51] Int. Cl.[4] ..... F25B 47/00

[52] U.S. Cl. ..... 62/171; 62/85; 62/188; 62/311; 261/DIG. 46

[58] Field of Search ..... 62/85, 195, 188, 183, 62/304, 305, 311, 171, 310; 165/900, 134.1; 210/101, 97; 261/DIG. 11, DIG. 46, DIG. 86

[56] References Cited

U.S. PATENT DOCUMENTS

| | | | |
|---|---|---|---|
| 2,885,246 | 5/1959 | De Haven | 302/49 |
| 2,969,347 | 1/1961 | Bellinger et al. | 260/94.9 |
| 2,984,991 | 5/1961 | Morgan | 62/121 |
| 3,078,918 | 2/1963 | Magearl et al. | 165/2 |
| 3,267,361 | 8/1966 | Maddox | 324/30 |
| 3,754,741 | 8/1973 | Whitehurst | 62/85 X |
| 3,918,469 | 11/1975 | Zamboni et al. | 261/DIG. 46 |
| 4,338,959 | 7/1982 | Krueger et al. | 137/93 |
| 4,475,356 | 10/1984 | Lewis | 62/183 |
| 4,507,930 | 4/1985 | Kaya et al. | 62/129 |
| 4,544,788 | 10/1985 | Daviduk et al. | 585/501 |
| 4,610,574 | 9/1986 | Peters | 406/50 |

FOREIGN PATENT DOCUMENTS

| | | | |
|---|---|---|---|
| 1343664 | 1/1974 | United Kingdom | 261/DIG. 46 |

*Primary Examiner*—Harry B. Tanner

*Attorney, Agent, or Firm*—Alexander J. McKillop; Charles J. Speciale

[57] ABSTRACT

A conventional evaporator of a cooling tower system is modified so that anti-corrosion additives are introduced into the cooling tower system in response to the flow of make-up water into the cooling tower to replenish the supply of recirculating water.

5 Claims, 2 Drawing Sheets

METHOD AND APPARATUS FOR MAINTAINING A CONSTANT ACTIVE CONCENTRATION IN A COOLING TOWER

BACKGROUND OF THE INVENTION

1. Field of Invention

The present invention relates to a method and apparatus for controlling the concentration of an additive in the recirculating water of a cooling tower system.

2. Description of the Prior Art

In a cooling tower system, it is important to maintain a constant concentration of additives in the recirculating liquid, which additives prevent corrosion to the components of the cooling tower.

Ordinary ground water is primarily used as the cooling medium in many types of cooling towers Corrosive elements, such as calcium and magnesium, are thus present in the recirculating water of the cooling tower. As the water evaporates, the concentrations of the calcium and magnesium increase. The calcium and magnesium in high concentrations and over a period of time cause corrosion to the cooling tower system and in particular to the metallic parts of the system. For this reason, chemicals are added to the recirculating water to decrease the effect of the calcium and magnesium present in the water.

A typical cooling tower system is shown schematically in FIG. 1. In the conventional system, control of the additive concentration in the cooling tower is effected with a high-limit conductivity sensor. As its name implies, the conductivity sensor senses the conductivity of the recirculating water in the cooling tower. The conductivity of the water is directly proportional to the increased concentration of the corrosive elements in the water (i.e., the calcium and magnesium).

Most conventional cooling towers of this type include a blow-down valve, which valve removes recirculating water from the cooling tower system. Make-up water is added through another conduit, and the make-up water is controlled by a float sensor, for example, which detects the proper level of water in the tower.

In conventional cooling tower systems of the type shown in FIG. 1, the blow-down valve is actuated in response to a signal from the conductivity sensor which detects a high concentration of corrosive elements in the recirculating water. When the blow-down valve is actuated, a quantity of recirculating water is removed from the cooling tower system. When the water in the cooling tower falls below a predetermined level detected by the float sensor, a make-up water valve is actuated to replenish the supply of water in the cooling tower.

In the conventional cooling tower system, an additive pump (and possibly an associated valve) is provided, which pump when actuated introduces an anti-corrosion additive to the cooling tower. The additive mixes with the water recirculating in the cooling tower system. The additive pump is actuated in response to the same signal that actuates the blow-down valve. In other words, the additive pump operates to add the additive to the cooling tower only during the time that the blow-down valve is open. The pump shuts down at the same time that the blow-down valve closes; this occurs when the conductivity detected by the conductivity sensor falls below a predetermined value.

A particular concentration of additive must be present in the recirculating water of the cooling tower system in order to prevent corrosion to the system components. However, the method of adding anti-corrosion additives for the same period of time that the blow-down valve is open and in response to the signal from the conductivity sensor is an imprecise way of controlling the concentration of additive in the recirculating water. The blow-down valve, through which recirculating water is removed from the system, and the make-up water valve, through which replenishing water is added, are actuated independently of each other, the former by the conductivity sensor and switch, and the latter by the float sensor which detects the water level in the cooling tower. Thus, when the blow-down valve is off, the make-up water valve may still be on, with water continuing to flow into the tower. Accordingly, it is possible that the additive pump, which shuts down when the blow-down valve closes, stops pumping additive into the cooling tower prematurely, that is, while the make-up water is still being added to the cooling tower. Thus, the concentration of additive in te recirculating water of the cooling tower system may fall below a level that is sufficient to inhibit corrosion of the system components.

Furthermore, if water from the recirculating water evaporates, the make-up water solenoid valve will be energized even though blow-down has not occurred. Since in the conventional system the additive pump is tied directly to the same circuit that controls blow-down, no anti-corrosion additive is introduced into the system to mix with the make-up water that is added to replenish the recirculating water that has evaporated. Therefore, the concentration of the corrosion additive in the recirculating water decreases.

OBJECTS AND SUMMARY OF THE INVENTION

It is an object of the present invention to provide an apparatus and method for controlling, with a high degree of precision, the amount of anti-corrosion additive which is introduced into a cooling tower system.

It is a further object of the present invention to overcome the disadvantages of known methods for monitoring and controlling the additive concentration in the recirculating liquid of a cooling tower system.

In accordance with one embodiment of the present invention, a conventional cooling tower system such as described previously is modified by adding a flow meter in series with the make-up water valve to measure the amount of make-up water which is added to the cooling tower. The flow meter provides a signal which is directed to the additive feed pump and valve. An automatic actuator or additive feed controller receives the signal from the flow meter and, in turn, sends a signal to the additive feed pump. The pump will be energized and will control the rate and amount of additive introduced into the system in response to the quantity and rate of make-up water added to the cooling tower, which quantity and rate is measured by the flow meter. By disassociating the additive pump in the conventional system from direct control by the conductivity sensor and by energizing the pump or the amount of additive introduced into the system in response to the flow of make-up water measured by the flow meter, the present invention provides an accurate control of the additive concentration in the cooling tower system.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
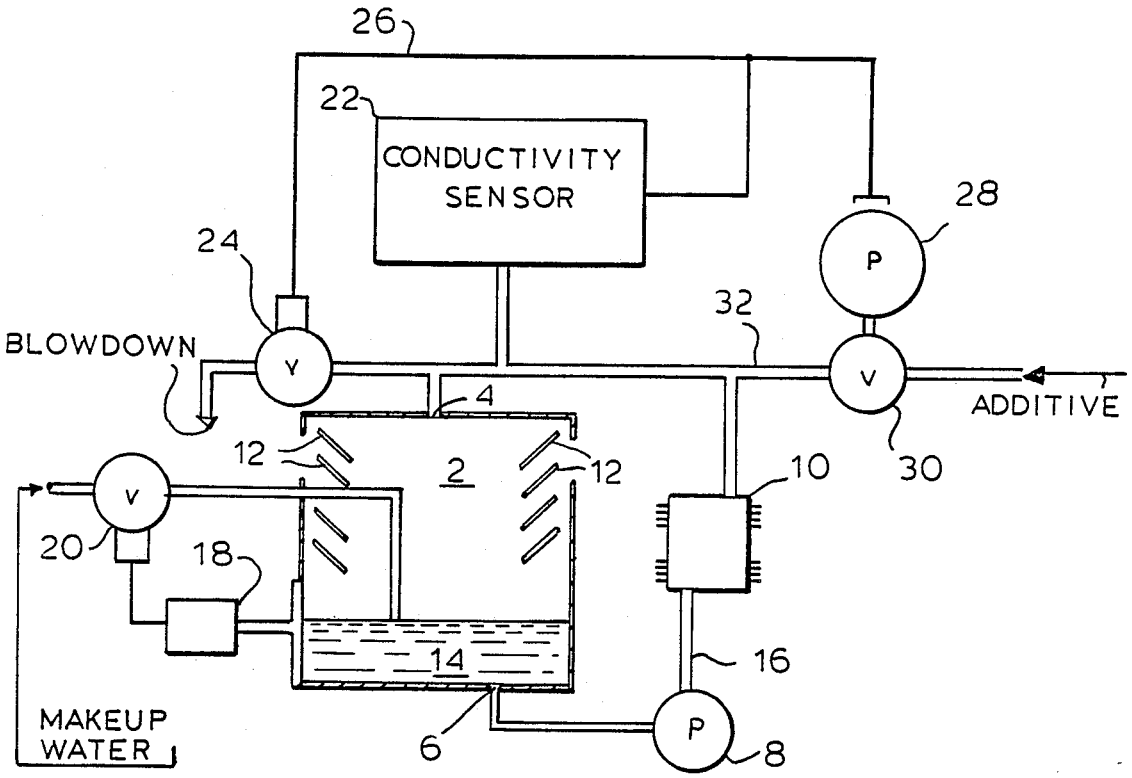
Fig. 1 (PRIOR ART)
FIG. 1 is a schematic representation of a conventional cooling tower system.

With reference to FIG. 1 of the drawings, it will be seen that a conventional evaporative-type cooling tower system includes a cooling tower 2 having a water inlet 4 at its top and a water outlet 6 at its bottom. The water outlet 6 is connected to a pump 8 which pumps the water to a heat exchanger 10 for cooling another fluid. Heat from the fluid to be cooled is transferred to the recirculating water of the cooling tower system, which water then flows to the water inlet 4 at the top of the cooling tower. The water flows into the cooling tower 2 and gravitates therethrough. As it gravitates through the cooling tower, it strikes baffles, partitions or other means 12 which are employed to break up the water into fine droplets, which has the effect of exposing more surface area of the water. Cooling air flows through the cooling tower and contacts the water droplets gravitating through the tower, cooling the water. The recirculating water is captured at the bottom of the cooling tower to form a pool 14. Thus, the water inlet 4, water outlet 6, pump 8 and associated interconnecting piping form a loop circuit 16 through which the recirculating water passes.

A water level sensor 18 detects the level of the pool of water in the cooling tower. The water level sensor 18 provides a signal to a solenoid valve 20 which is connected in line with a source of make-up water. The source of make-up water is connected to the cooling tower 2 to supply additional water to the cooling tower whenever the water level in the cooling tower detected by the level sensor falls below a predetermined amount. The level sensor 18 turns on the solenoid valve 20 to allow make-up water to flow into the cooling tower. When the water level rises to a predetermined level, the level sensor 18 shuts off the solenoid valve 20, which stops the flow of make-up water into the cooling tower.

In one form of the cooling tower system, the water level sensor 18 may include a float which is mechanically coupled to the make-up water valve 20 (that is,the valve is not solenoid operated). As will be seen, a flow meter may be added in series with the valve 20, in accordance with the present invention, which flow meter will provide a signal indicative of when make-up water flows into the cooling tower.

The water which is used in the cooling tower may be ordinary ground water. Thus it may contain corrosive elements, such as calcium and magnesium. The concentration of such corrosive elements is directly proportional to the conductivity of the water, and as such, the measurement of the conductivity of the water is a conventional and useful method of determining the concentration of the corrosive elements in the water.

The conductivity of the make-up water is typically about 200 μohms per centimeter. As the water in the cooling tower evaporates, the concentration of the corrosive elements increases such that the conductivity of the recirculating water may rise to 800 μohms per centimeter or higher.

It has been determined that corrosion to the cooling tower components will increase rapidly when the recirculating water reaches a conductivity of about 800 μohms per centimeter. Accordingly, it is sought to decrease the concentration of corrosive elements in the recirculating water when such value is reached.

As shown in FIG. 1, one conventional method of doing this is by using a conductivity sensor 22 connected to the loop piping 16 carrying the recirculating water. The conductivity sensor 22 measures the conductivity of the recirculating water. When the conductivity of the recirculating water is equal to or greater than 800 μohms per centimeter, the conductivity sensor produces an output signal indicative of this high level of conductivity.

The output signal from the conductivity sensor 22 is provided to a solenoid valve 24, as illustrated by the dashed line 26 in FIG. 1. The solenoid valve 24 is part of a blow-down circuit which taps the recirculating water fed to the cooling tower. The recirculating water that is tapped by the blow-down valve is discharged.

When the level of the water in the pool at the bottom of the cooling tower falls below a predetermined amount due to activation of the blow-down valve and the discharge of water, the water level sensor 18 will trip and signal the make-up water valve 20 to turn on, allowing make-up water to flow into the cooling tower to replenish the supply of water therein. The make-up water which replenishes the water discharged through the blow-down valve 24 has a lower concentration of corrosive elements. The make-up water mixes with the recirculating water still in the system and reduces the concentration of the corrosive elements of the recirculating water and, accordingly, the conductivity of the water.

When the conductivity of the recirculating water detected by the conductivity sensor 22 falls below a predetermined value, such as 800 μohms per centimeter, the conductivity sensor will signal the blow-down valve 24 to close, thus stopping the flow of recirculating water discharged from the cooling tower system.

In the conventional system shown in FIG. 1, anti-corrosion additives are introduced into the system to inhibit the corrosion of the cooling tower system components. The circuit for adding these anti-corrosion additives includes an additive pump 28 and an associated valve 30, and piping 32 connected from the valve and pump to the recirculating water loop circuit 16.

A signal from the conductivity sensor 22 is provided to the additive pump 28 and valve 30 to energize the additive pump and open the valve so that anti-corrosion additive is introduced into the recirculating water whenever the conductivity sensor detects a high level of conductivity, such as above 800 μohms per centimeter.

The problem with the conventional cooling tower system is that the anti-corrosion additives are introduced into the system in response to the same or a corresponding signal from the conductivity sensor 22 which controls the blow-down valve 24. Whenever the blow-down valve 24 is open and removing water from the cooling tower system, the additive pump 28 and valve 30 are energized and anti-corrosion additive is introduced into the recirculating water. When the blow-down valve 24 is closed in response to a low level of conductivity in the recirculating water detected by the conductivity sensor 22, the additive pump 28 also is turned off, and no further anti-corrosion additive is introduced into the system.

The make-up water valve 20, on the other hand, is independently controlled by the level sensor 18 in the cooling tower, and is not controlled by the conductivity sensor 22. Accordingly, the make-up water added to the cooling tower may continue to flow to replenish the supply of recirculating water in the cooling tower system even though the blow-down valve 24 has closed and the additive pump 28 has stopped. Thus, the make-up water which continues to flow into the cooling tower dilutes the concentration of anti-corrosion additive which has been introduced into the cooling tower system and mixed with the recirculating water. The concentration of the additive may fall below that which is sufficient to prevent corrosion of the cooling tower system components.

Figure 2:
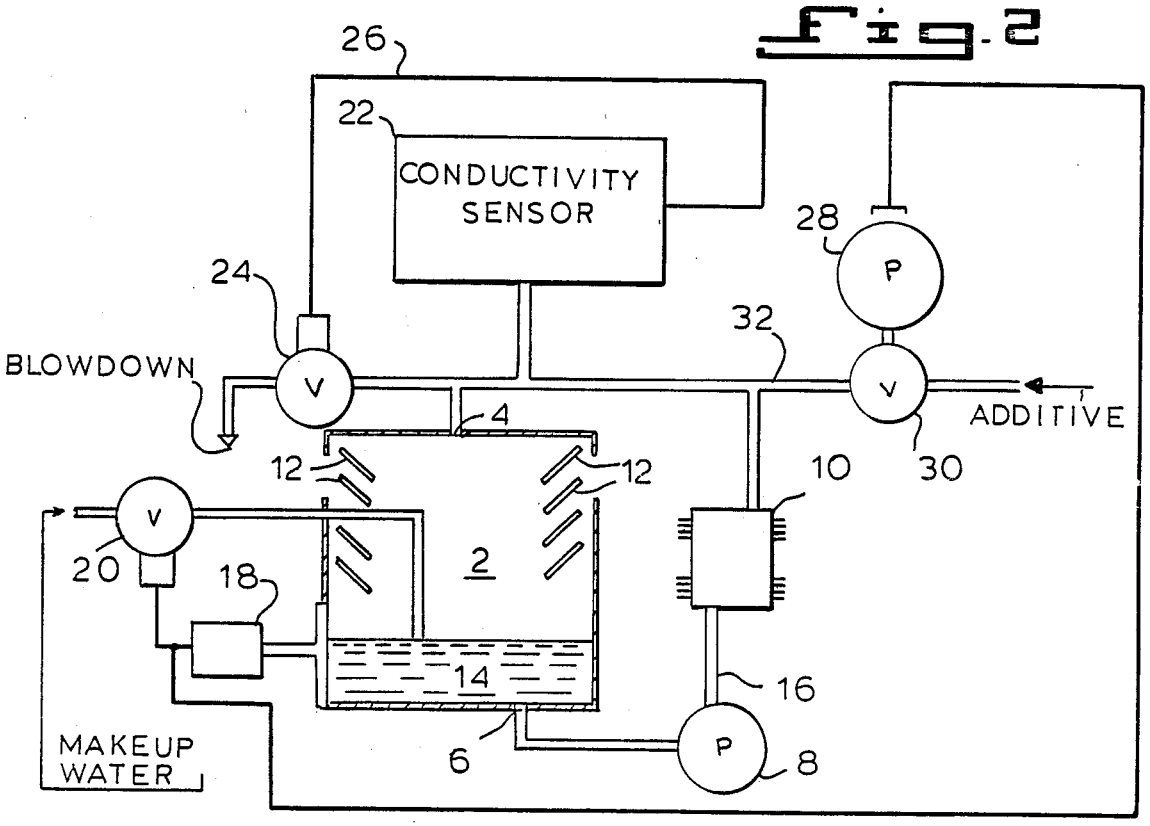
FIG. 2 is a schematic representation of the cooling tower system shown in FIG. 1 modified in accordance with one form of the present invention.

This inherent problem has been overcome with the present invention by modifying the cooling tower system shown in FIG. 1, as schematically represented in FIG. 2. In its most basic form, the present invention breaks the connection between the conductivity sensor 22 and the additive pump 28 and valve 30 so that the additive pump 28 is no longer energized in response to the level of conductivity detected by the conductivity sensor.

In the modified cooling tower system of the present invention shown in FIG. 2, a signal from the make-up water solenoid valve 20, which signal indicates when the valve opens and closes to allow make-up water to flow into the cooling tower, or the signal from the water level sensor 18 to the valve 20, which signal instructs the valve to open and close, is provided to the additive pump 28 and valve 30 to turn on the additive pump and valve only when the make-up water solenoid valve 20 is open, and to turn off the additive pump and valve when the make-up water solenoid valve is closed. Thus, in accordance with the present invention, anti-corrosion additives are introduced into the cooling tower system whenever make-up water is added to the cooling tower. In this manner, the proper concentration of anti-corrosion additives can be maintained in the recirculating water of the cooling tower system. This overcomes the problem in the conventional cooling tower system illustrated by FIG. 1 and described above where the make-up water may continue to flow after the blow-down operation has been completed, which make-up water may dilute the concentration of additive in the recirculating water.

The additive pump 28 and valve 30 are adjusted so that they introduce anti-corrosion additive either in spurts or in a steady flow in the proper amount. The amount of anti-corrosion additive introduced into the cooling tower system is proportional to the known flow rate of the make-up water introduced into the cooling tower. For example, the additive pump and valve may be adjusted so that anti-corrosion additive of about 1 cc per minute is added to the cooling tower for as long as the make-up water continues to flow.

Figure 3:
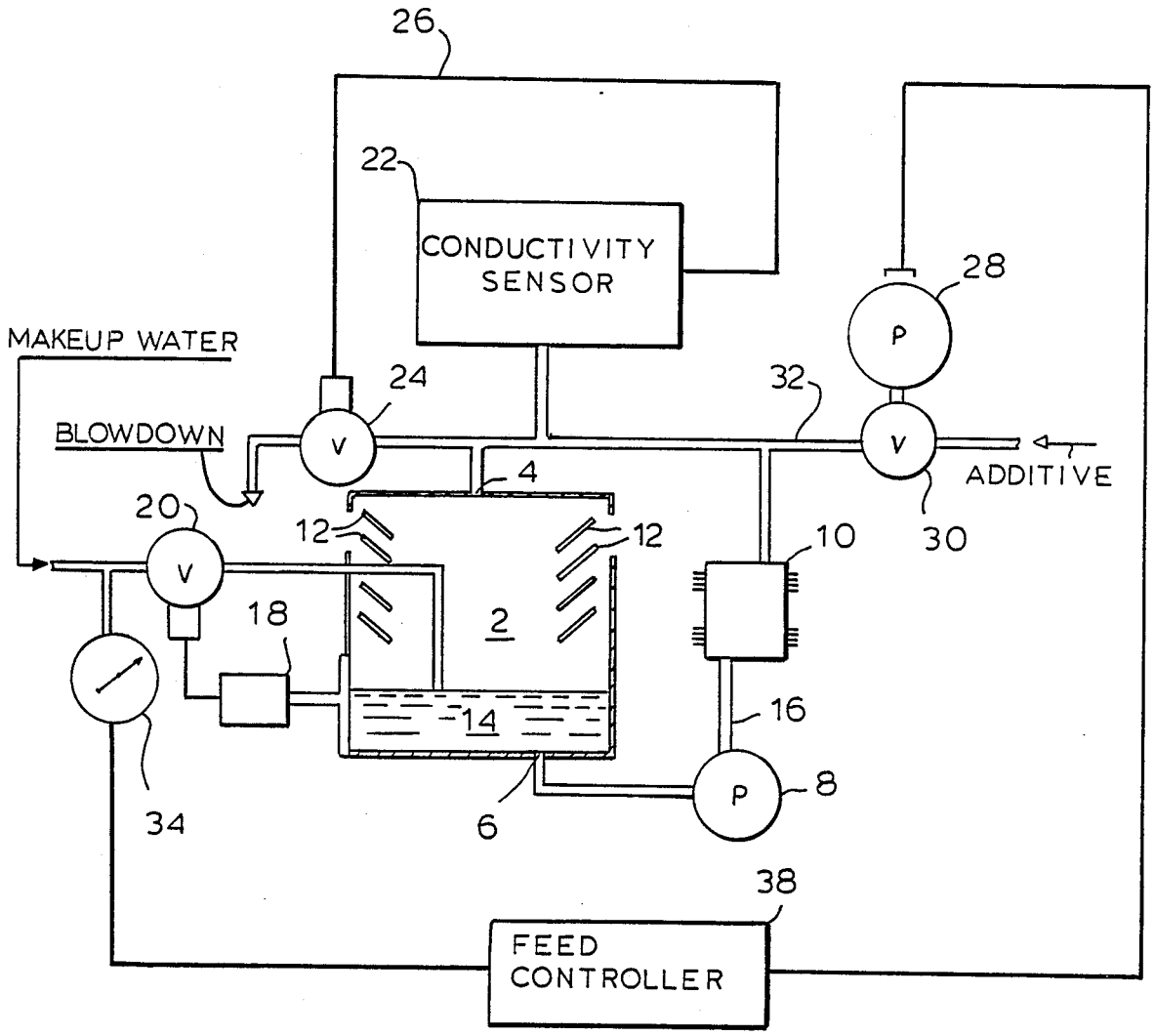
FIG. 3 is a schematic representation of the cooling tower system shown in FIG. 1 modified in accordance with a second form of the present invention.

In an alternative form of the invention illustrated schematically by FIG. 3, a flow meter 34 may be connected to the make-up water piping 36. The flow meter 34 is particularly useful in a cooling tower system which employs a mechanically linked float-type water level sensor 18 and make-up water valve 20, as described previously, where no signal is provided by the float-type sensor. The flow meter 34 may provide an analog or digital signal indicative of the amount of make-up water flowing into the cooling tower 2. The additive pump valve 30, which in the embodiment of FIG. 2 is an on/off type valve that is preset to provide a certain flow of additive into the cooling tower system, may be replaced by an adjustable valve which can control and vary the flow of additive in response to the signal from the make-up water flow meter 34. Accordingly, if the make-up water flow varies, the variation will be sensed by the make-up water flow meter 34 and indicated by its output signal. The additive pump 28 and valve 30 will adjust the amount of additive introduced into the cooling tower system in response to the varying output signal from the make-up water flow meter. This will provide an even closer control of the amount of anti-corrosion additive introduced into the cooling tower system, in response to the rate of flow of the make-up water into the cooling tower.

In yet another form of the invention illustrated by FIG. 3, the flow meter 34 may provide its signal to an automatic actuator or additive feed controller 38. In response to the flow meter signal, the feed controller 38 generates an output signal and provides this signal to the additive feed pump 28 to control the energization of the pump. Many pumps employed in cooling tower systems have a stroke adjuster. The signal from the feed controller 38 may be provided to the stroke adjuster of the pump to vary the stroke produced by the pump and, consequently, the amount of additive introduced into the system. Other pumps are, in effect, AC motors. With such pumps, the feed controller 38 can be a conventional silicon controlled rectifier (SCR) circuit, which will vary the duty cycle of a power signal to the pump 28 to control its speed and the quantity and rate at which additive is introduced into the system.

It is evident from the above description of the present invention that a closer control of the concentration of anti-corrosion additive in the recirculating water of the cooling tower system is provided. By disconnecting the control of the additive pump 28 and valve 30 from the conductivity sensor 22, and connecting the additive pump 28 to the make-up water control circuit, a proper concentration of anti-corrosion additive in the recirculating water may be maintained.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An evaporative cooling tower system, which comprises:

an evaporative cooling tower having a liquid inlet and liquid outlet, and conduit means interconncting the inlet and outlet for the passage of recirculating liquid therethrough and into and out of the cooling tower, the cooling tower, liquid inlet and liquid outlet and conduit means defining a recirculating liquid circuit;

means for discharging recirculating liquid from the recirculating liquid circuit, the recirculating liquid discharging means being coupled to the recirculating liquid circuit to allow the removal of recirculating liquid therefrom;

means for adding make-up liquid to the recirculating liquid circuit to replenish the recirculating liquid that has evaporated or has been discharged by the discharging means, the make-up liquid adding means being coupled to the recirculating liquid circuit;

means for sensing the conductivity of the recirculating liquid, the conductivity sensing means being coupled to the recirculating liquid circuit, the conductivity sensing means providing an output signal to the recirculating liquid discharge means, the discharge means being responsive to the output signal from the conductivity means to discharge liquid from the recirculating liquid circuit;

means for sensing the level of liquid in the cooling tower, the liquid level sensing means being operatively coupled to the make-up liquid adding means, wherein the adding means is controlled by the liquid level sensing means to provide make-up liquid to the recirculating liquid circuit;

means for sensing the flow of make-up liquid to the recirculating liquid circuit, the make-up liquid flow sensing means providing an output signal indicative of the flow of make-up liquid into the recirculating liquid circuit;

means for adding an anti-corrosion additive to the recirculating liquid circuit, the anti-corrosion additive adding means providing additive to the circuit in response to the output signal form the make-up liquid flow sensing means so that anti-corrosion additive is added to the recirculating liquid circuit when make-up liquid is flowing, the anti-corrosion additive means being in the form of a pump having an AC-type motor; and an additive feed controller, the additive feed controller being responsive to the output signal from the make-up liquid flow sensing means and providing an output signal, the anti-corrosion additive adding means being responsive to the output signal from the feed controller, the additive feed controller having a silicon controlled rectifier circuit, which circuit will vary a power signal supplied to the pump to control the speed and the quantity and rate at which additive is added to the system;

wherein the make-up liquid flow sensing means provides an output signal which is indicative of the rate of flow of make-up liquid to the recirculating liquid circuit; and wherein the anti-corrosion additive means is responsive to the output signal from the make-up liquid flow sensing means to adjust the rate at which anti-corrosion additive is added to the recirculating liquid circuit.

2. An evaporative cooling tower system as defined by claim 1, wherein the recirculating liquid discharge means is a blow-down valve.

3. An evaporative cooling tower system as defined by claim 1, wherein the make-up liquid adding means is a solenoid-operative valve.

4. An evaporative cooling tower system as defined by claim 1, wherein the conductivity sensing means includes a conductivity sensor connected to the conduit means of the recirculating liquid circuit.

5. An evaporative cooling tower system as defined by claim 1, wherein the liquid level sensing means includes a float valve disposed in the cooling tower.

* * * * *